United States Patent [19]

Davis

[11] 4,246,682

[45] Jan. 27, 1981

[54] METHOD OF MAKING CATHODE SUPPORT NICKEL STRIP

[75] Inventor: George L. Davis, Coulsdon, England

[73] Assignee: U.S. Philips Corporation, New York, N.Y.

[21] Appl. No.: 966,913

[22] Filed: Dec. 6, 1978

[30] Foreign Application Priority Data

Dec. 6, 1977 [GB] United Kingdom ..... 50723/77

[51] Int. Cl.[3] ..... H01J 9/02

[52] U.S. Cl. ..... 29/25.11; 29/25.17

[58] Field of Search ..... 313/346 R; 29/25.11, 29/25.17; 316/24

[56] References Cited

U.S. PATENT DOCUMENTS

| | | | |
|---|---|---|---|
| 3,425,111 | 2/1969 | Denison, Jr. | 313/346 R |
| 3,730,706 | 5/1973 | Beuscher | 75/206 |
| 3,911,309 | 10/1975 | Kummel et al. | 313/346 R |
| 4,081,713 | 3/1978 | Misumi | 313/346 R |
| 4,114,243 | 9/1978 | Soeno et al. | 29/25.18 X |

OTHER PUBLICATIONS

A. C. Aten et al., "Chemical Transport in Oxide Cathodes", vol. 26, Phillips Research Reports, 1971, pp. 519–531.

*Primary Examiner*—Richard B. Lazarus

[57] ABSTRACT

The cathode support is made from a mixture of nickel powder and nickel coated particles of an alloy containing nickel and an activator capable of reducing barium oxide to barium by compacting the mixture and sintering it at a temperature between 900° to 1100° C.

12 Claims, 6 Drawing Figures

METHOD OF MAKING CATHODE SUPPORT NICKEL STRIP

Figure 1:
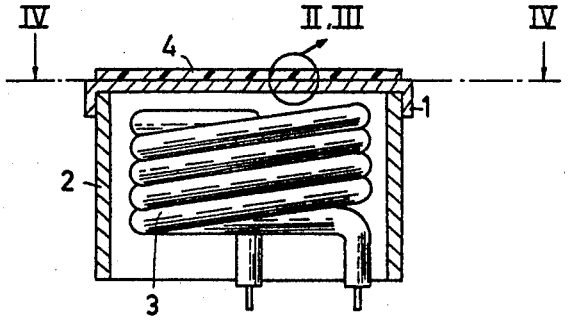

The invention relates to a method of making a cathode support nickel strip comprised of nickel containing an activator element, to a cathode support strip made by such a process, to an oxide cathode having a support made from such a cathode support strip, and to an electron tube including such an oxide cathode.

Oxide cathodes may be used in electron tubes such as display tubes, television camera tubes, transmitting tubes, klystrons and magnetrons.

A cathode support strip consisting of nickel containing an activator element such as Al, C, Mg, Si or Zr, has been made by a powder metallurgy method in which a mixture of the constituent powders is compressed to form a block, the compressed block is sintered, and the sintered ingot is rolled. This method requires a powerful press, which is expensive, and the centre of the ingot is relatively porous. It is necessary to sinter large ingots at relatively high temperatures for a long time, for example at 1300° C. for 48 hours, in order to reduce the porosity of the centre of the ingot. However, such a process is not suitable without taking troublesome precautions such as encapsulating the ingot when the activator element is magnesium, which boils off at 1100° C.

An object of the invention is to provide a method of making a cathode support nickel strip in which an activator element is inhomogeneously distributed. It was found that this inhomogeneous distribution favourably modifies the effective diffusion rate of the activator element to the surface of the strip during the early life of the cathode.

A disadvantage of known oxide cathodes using a known cathode support nickel strip is that the quantity of free barium available when the cathode is first operated is reduced considerably by gas residues in the electron tube in which the cathode is used, which residues form a compound with the free barium. This is termed the poisoning of the cathode. Such poisoning gas residues are formed not only as a result of insufficient evacuation of or leaks in the electron tube (a good vacuum of $10^{-7}$ mm Hg still means $10^{-9}$ moles of gas per $cm^3$) but also as a result of heating and evolution of gases from components in the tube. Moreover, the cathode-poisoning gases can be formed upon impact of electrons with materials and the gas may be released from the glass wall of the electron tube. As already said, cathode poisoning occurs in particular at the beginning of the operation of the cathode so that the tube in which such a cathode is used initially shows a poor operation as a result of a poor cathode emission.

It is another object of the invention to provide an oxide cathode which rapidly achieves good emission at the beginning of its operation in an electron tube.

The invention provides a method of making a cathode support nickel strip comprising the steps of preparing a mixture comprising nickel-coated particles of an alloy of nickel with an activator element, and carbonyl nickel powder, rolling the mixture to form a compacted strip, sintering the compacted strip at a temperature of from 900° to 1100° C. in a non-oxidising atmosphere, and rolling the sintered strip so as to form a cathode support nickel strip of the desired thickness, wherein the activator element is capable of reducing barium oxide to barium at the operating temperature of an oxide cathode. The activator element is inhomogeneously distributed in the nickel strip made by a method according to the invention, in contrast to nickel strip made by rolling cast material where the distribution is homogeneous.

The activator element diffuses from the interior of the cathode support as a result of a concentration gradient of the activating element being set up between the oxide-bearing surface of the cathode support and the interior of the cathode support as a result of a reaction between barium oxide and the activating element at the surface of the cathode support. Thus free barium which was lost by reaction with gas residues in the electron tube is replaced. Diffusion occurs at acceptable rates as a result of the high temperature of the cathode support during operation of the cathode. The nickel coating surrounding the particles of an alloy of nickel and an activator element makes it possible to sinter the compacted strip at high speeds and low temperatures, and makes the sintering process easier to control.

When magnesium is used as an activator element, it is introduced into the powder mixture in the form of nickel-coated particles of a nickel-magnesium alloy, for example containing 15% by weight of magnesium coated with such a thickness of nickel that the magnesium content of the coated particles is 2% by weight. By introducing the magnesium in this manner, the nickel-magnesium alloy is protected from oxidation by traces of oxygen which are inevitably present in the sintering atmosphere. It is convenient to incorporate in the mixture aluminium in the form of a nickel-alluminium alloy containing, for example 52% by weight of aluminium. When the activator element is magnesium, the magnesium content of the nickel strip may be from 0.03 to 0.15% by weight. When the nickel strip includes aluminium, the aluminium content of the nickel strip may be from 0.01 to 0.10% by weight. Activator elements include Si, the lanthanides, Th, Zr, Be and C. Commercially available carbonyl nickel powder consists of more than 99% by weight of nickel, together with small quantities of iron and cobalt, in addition to trace impurities. Small quantities of other elements, such as tungsten, may be included in the mixture in order to improve the mechanical properties of the nickel strip.

The nickel-coated particles of the alloy of nickel with an activator element are thoroughly mixed with carbonyl nickel powder and any other ingredients of the mixture. A strip is then rolled from the mixture, the thickness of the compacted strip being governed by the apparatus available. The compacted strip is then sintered, and the sintered strip is then rolled so as to reduce the thickness of the strip to a desired value. The rolled strip may be annealed if desired.

Figure 2:
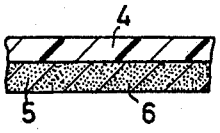
Figure 3:
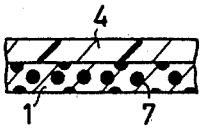
Figure 4:
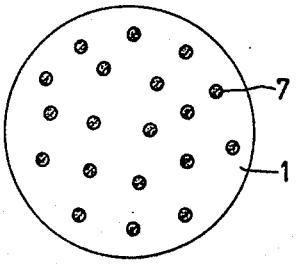
Figure 5:
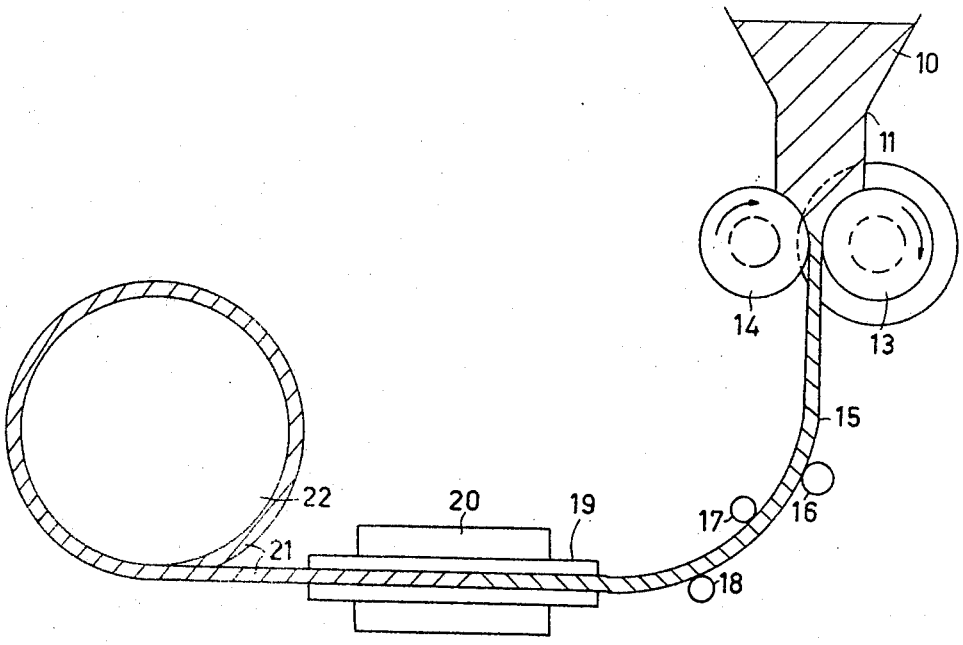
Figure 6:
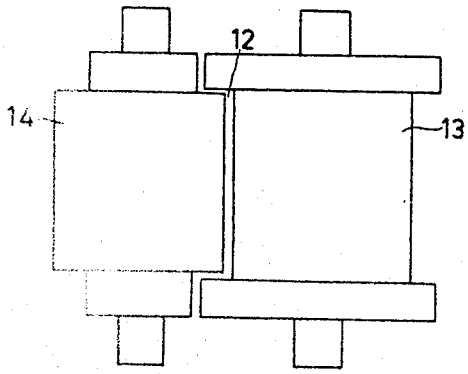

An embodiment of the invention will now be described with reference to the accompanying drawings, in which:

FIG. 1 is a sectional elevation of an oxide cathode,

FIG. 2 is a sectional elevation of a known cathode support bearing a barium-calcium-strontium oxide layer, FIG. 3 is a sectional elevation of a cathode support nickel strip made by a method according to the invention bearing a barium-calcium-strontium oxide layer, FIG. 4 is a plan view of a disc of a cathode support nickel strip made by a method according to the invention, FIG. 5 is a schematic side elevation of an apparatus used to make a sintered compacted strip by a method according to the invention, and FIG. 6 is a plan view of the rollers of the apparatus shown in FIG. 5.

A magnesium-nickel alloy containing 15% by weight of magnesium in the form of lumps was crushed, ground and sieved, the material passing a 350 mesh (meshes per inch) sieve being collected. This minus 350 mesh material was coated with a thickness of nickel such that the magnesium content of the coated particles was 2% by weight. The particles were coated with nickel in an autoclave by the reduction of an aqueous ammoniacal solution containing nickel sulphate and ammonium sulphate heated to 175° C., the autoclave containing an over-pressure of 350 lbs/in$^2$ of hydrogen.

A master mixture comprising of equal weights of tungsten powder and carbonyl nickel powder having average particle sizes of 3 μm was prepared. An aluminium-nickel (52/48 by weight) powder was sieved through a 400 mesh sieve and the minus 400 mesh fraction was used.

A mixture was prepared containing 80 g of the nickel-coated magnesium-nickel alloy particles 1.6 g of the minus 400 mesh aluminium-nickel alloy powder 80 g of the tungsten and carbonyl nickel master mixture 1840 g of carbonyl nickel powder.

This mixture contains 0.08% Mg, 0.04% by weight Al, and 2% by weight W.

Referring to FIGS. 5 and 6 of the drawings, the powder mixture 10 was fed into a hopper 11 from which the powder passed into a 0.6 mm wide gap 12 between two 150 mm diameter rollers 13, 14 running in the horizontal plane. The compacted strip 15 passed over support rollers 16, 17 and 18 before entering a muffle tube 19 of a muffle furnace 20 in which the strip 15 was sintered. Pure, dry hydrogen was passed through the muffle tube 19 and the strip was passed through the furnace at a rate such that a peak temperature of 1050° C. was applied for 3 minutes. The sintered strip 21 emerging from the muffle tube 19 was wound onto a 600 mm diameter spool 22. The sintered strip was 0.7 mm thick and was subsequently rolled to give a final thickness of 100 μm. This 100 μm strip was used to make oxide cathodes.

FIG. 1 shows an oxide cathode comprising a support 1 made of the strip made by the method described with reference to FIGS. 5 and 6, secured to a cathode shank 2. A heater element 3 is situated below the support 1. The support 1 bears a layer 4 of (BaCaSr)0. This layer 4 is obtained by spraying a suspension of barium-calcium-strontium carbonate onto the support 1 and converting the carbonate into (BaCaSr)0 by heating.

FIG. 2 shows a part of a prior art support 1 bearing an emissive layer 4. This prior art support was produced from a casting of or a high temperature sintered powder metallurgy alloy of nickel and an activator element 5 which is shown as dots homogeneously distributed in the nickel of the support and which diffuses into the emissive layer 4 during operation of the cathode. When the emissive layer 4 has been poisoned, the BaO in this cathode is not reduced sufficiently rapidly so that the emission of the cathode continues at a lower level than was the case before posoning.

FIG. 3 shows a part of the support 1 produced by a method according to the invention bearing the emissive layer 4. The activator element 6 (Mg and Al) are present in the nickel of the support and at the surface of the support in a locally concentrated form. As a result of this it initially diffuses considerably more rapidly into the emissive layer 4 and can rapidly replenish the Ba which has been lost as a result of poisoning.

FIG. 4 is a plan view of the support 1 made by a method according to the invention in which the islands 6 having a high concentration of activator element are situated. It will be obvious that the cathode nickel may also be used in other cathode constructions, and activator elements and alkaline earth metal oxides other than those described may be used.

What is claimed is:

1. A method of making a cathode support comprising the steps of preparing a mixture comprised of nickel powder and nickel coated particles of an alloy comprised of nickel and an activator capable of reducing barium oxide to barium, compacting the mixture and sintering the compacted mixture at a temperature between 900° and 1100° C. to thereby form said support.

2. The method according to claim 1 wherein said strip is sintered in a generally non-oxidizing atmosphere.

3. The method according to claim 2 wherein said strip is sintered in a hydrogen atmosphere.

4. The method according to claims 1 or 2 wherein said compacting step includes rolling said mixture to form from said mixture a compacted strip and including the step of rolling the sintered strip to the desired thickness.

5. The method according to claim 4 wherein said sintering step includes passing said compacted strip through a furnace at a rate such that the strip is exposed to a peak temperature of approximately 1050° C. for approximately three minutes.

6. The method according to claim 1 including the step of coating particles of said alloy with nickel by reducing an aqueous ammoniacal solution containing nickel sulfate and ammonium sulfate in an autoclave containing an over pressure of hydrogen.

7. The method according to claim 6 wherein said solution is heated to approximately 175° C. and said over-pressure is approximately 350 pounds per square inch.

8. The method according to claim 1 wherein said activator is magnesium.

9. The method according to claim 1 wherein said nickel coated particles are comprised of a magnesium-nickel alloy and said mixture further includes particles of an aluminium-nickel alloy.

10. The method according to claims 8 or 9 wherein said mixture contains from 0.03 to 0.15 percent by weight of magnesium.

11. The method according to claim 9 wherein said mixture contains from 0.01 percent to 0.10 percent by weight of aluminium.

12. A method of making a cathode support strip comprising the steps of preparing a mixture comprised of carbonyl nickel powder and nickel coated particles of an alloy comprised of nickel and an activator capable of reducing barium oxide to barium, rolling the mixture to form a compacted strip, sintering the compacted strip in a non-oxidising atmosphere at a temperature between 900° and 1100° C. and rolling the sintered strip to form a support strip of the desired thickness.

* * * * *

UNITED STATES PATENT AND TRADEMARK OFFICE

CERTIFICATE OF CORRECTION

PATENT NO. : 4,246,682

DATED : Jan. 27, 1981

INVENTOR(S) : GEORGE L. DAVIS

It is certified that error appears in the above-identified patent and that said Letters Patent are hereby corrected as shown below:

On the Title Page under Foreign Application Priority Data, item [30], insert -- Nov. 14, 1978 [GB] United Kingdom .... 44331-78 --

Signed and Sealed this

Sixth Day of October 1981

[SEAL]

*Attest:*

GERALD J. MOSSINGHOFF

*Attesting Officer*

*Commissioner of Patents and Trademarks*